United States Patent [19]

Nakatani

[11] 4,123,884

[45] Nov. 7, 1978

[54] MODULAR CONSTRUCTION FOR PREFABRICATED HOUSE

[75] Inventor: Shuhichi Nakatani, Osaka, Japan

[73] Assignee: Kubota Tekko Kabushiki Kaisha, Osaka, Japan

[21] Appl. No.: 793,347

[22] Filed: May 3, 1977

[30] Foreign Application Priority Data

Oct. 7, 1976 [JP] Japan ..... 51-121437

[51] Int. Cl.[2] ..... E04B 5/48

[52] U.S. Cl. ..... 52/220; 52/238; 52/241; 52/483; 52/509

[58] Field of Search ..... 52/122, 127, 238, 243, 52/36, 39, 241, 242, 483, 586, 309.8, 220, 509

[56] References Cited

U.S. PATENT DOCUMENTS

| | | | |
|---|---|---|---|
| 2,497,887 | 2/1950 | Hilpert | 52/122 X |
| 2,795,305 | 6/1957 | Bagge | 52/122 X |
| 2,886,147 | 5/1959 | Chasteney et al. | 52/122 |
| 3,055,061 | 9/1962 | Dadras | 52/36 X |
| 3,122,216 | 2/1964 | Boltz et al. | 52/238 X |
| 3,133,322 | 5/1964 | Douglas | 52/238 |
| 3,251,163 | 5/1966 | Russell | 52/238 X |
| 3,378,977 | 4/1968 | Vervloet | 52/238 X |
| 3,453,790 | 7/1969 | Harris | 52/122 X |
| 3,600,870 | 8/1971 | Greenhalgh | 52/122 X |
| 3,608,266 | 9/1971 | Satkin et al. | 52/127 X |
| 3,693,308 | 9/1972 | Trezzini et al. | 52/127 X |
| 3,835,600 | 9/1974 | Padula et al. | 52/122 X |
| 3,924,369 | 12/1975 | Guarino | 52/122 |

FOREIGN PATENT DOCUMENTS

| | | | |
|---|---|---|---|
| 418,597 | 2/1967 | Switzerland | 52/36 |

*Primary Examiner*—Alfred C. Perham

*Attorney, Agent, or Firm*—Griffin, Branigan and Butler

[57] ABSTRACT

A prefabricated house is provided with ceiling panels that are the same size, have a longitudinal dimension equal to or greater than $MP/m-D/m$ and a lateral dimension equal to or greater than $NP/n-D/n$ where MP and NP are the longitudinal and lateral inside dimensions of the ceiling plane for one floor of the house, $m$ and $n$ are integers representing the number of ceiling panels longitudinally and laterally disposed, and D is the thickness of a partition panel, whereby upon assembly of the ceiling panels a gap of width less than D exists over the place where a partition wall is to be erected. Partition wall panels are also of uniform dimensions hence partition wall panels for doors are offset from the wall line to compensate for one wall thickness. The ceiling panels are provided with a unique construction which facilitates the installation of electrical wiring and hides all fasteners which fasten the ceiling panels to the ceiling joists.

8 Claims, 25 Drawing Figures

MODULAR CONSTRUCTION FOR PREFABRICATED HOUSE

BACKGROUND OF THE INVENTION

In prior prefabricated house constructions, partition walls have been disposed with their upper portion projecting from the ceiling plane, and the ceiling panels have been sized to meet the dimension of a room. Thus, the inside dimension of the ceiling plane has seldom been an integer times a modular dimension because partition wall thicknesses tend to hinder a desired modular coordination. The use of reference-sized panels for ceiling assembly has been difficult. When deviation from modular coordination occurs, the outermost panel must be cut or modified at the house erection site. This increases labor costs and complicates the house assembly process.

In order to construct a ceiling assembly from reference panels, the dimensions of the ceiling plane as well as the panel units therefor must be held within fairly close tolerances during fabrication or the assembly of the panels is made more difficult. Furthermore, special consideration must be given to the provision of electrical wiring.

SUMMARY OF THE INVENTION

An object of this invention is to alleviate the foregoing problems and provide a ceiling-partition construction which facilitates ceiling assembly with the use of reference panels that do not require cutting or modification at the work site, provides an attractive finished ceiling plane wherein the panel fasteners are hidden, and provides convenient spaces through which electrical wiring may be extended.

An object of this invention is to provide a prefabricated house having a particular ceiling-partition construction which facilitates assembly of a ceiling plane from end to end all with reference panels.

A further object of this invention is to provide a particular joint construction for ceiling panels thereby facilitating the joint assembly thereof, decreasing the number of fasteners used and enhancing the beauty of the finished ceiling plane by covering all fasteners.

Another object of the invention is to provide a ceiling construction for a prefabricated house, said ceiling construction including a plurality of ceiling panels that are the same size, have a longitudinal dimension equal to or greater than $MP/m - D/m$ and a lateral dimension $NP/n - D/n$ where MP and NP are the longitudinal and lateral inside dimensions of the ceiling plane for one floor of the house, $m$ and $n$ are integers representing the number of ceiling panels longitudinally and laterally disposed and D is the thickness of a partition panel, whereby upon assembly of the ceiling panels a gap of width less than D exists over the place where a partition wall is to be erected.

Another object of this invention is to provide a prefabricated house having a particular gable roof construction which facilitates the assembly of outer panel walls, partition panel walls, connections of metal posts with outer panel walls, a partition panel wall with each other, the setting up of the gable roof, and the mounting of roof decks.

Other objects of the invention and its mode of assembly will become apparent upon consideration of the following description and the accompanying drawings.

DESCRIPTION OF PREFERRED EMBODIMENTS

Figure 1:
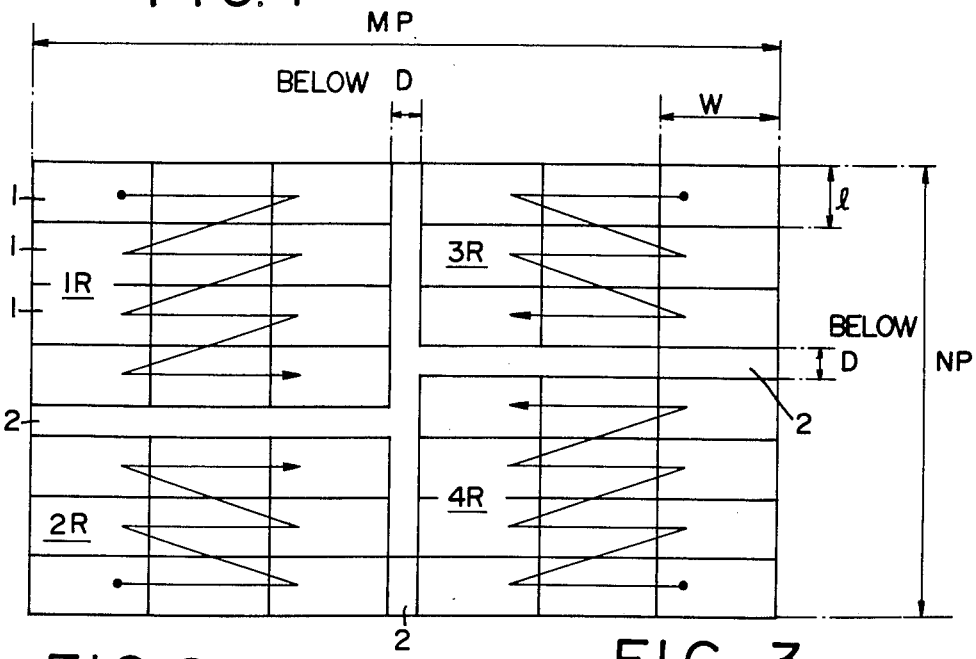
FIG. 1 is a top view of a ceiling panel arrangement according to this invention.

FIG. 1 shows a plan view of a given sized ceiling plane constructed with reference or standard sized ceiling panels 1 according to this invention. The dimensions of the reference panels 1 are determined in the following manner. The longitudinal dimension $w$ is chosen to be greater than or equal to the value $MP/m - D/m$ and the lateral dimension $l$ is chosen to be greater than or equal to $NP/n - D/n$ wherein MP is the longitudinal inside dimension of a ceiling, NP is the lateral inside dimension, $m$ is the number of ceiling panels to be longitudinally arranged, $n$ is the number of ceiling panels to be laterally arranged, and D is the thickness of a partition panel wall.

In respective room units 1R, 2R, 3R, and 4R, reference panels 1 are assembled in the order of the arrow directions shown, with gaps 2 less than the distance D being left where partition panel walls are to be vertically positioned. Gaps 2 compensate for dimensional errors arising during assembly of the ceiling plane from reference panels 1. The ceiling plane from end to end can be finished with reference panels 1. After assembling reference panels 1 in this manner, partition panel walls are assembled, whereupon the partition panel walls are positioned immediately below gaps 2 to have their upper portion extend upwardly no further than the bottom surface of the ceiling plane. Since a gap 2 is a distance not over the thickness D of a partition panel wall, the gaps will be covered by the thickness of a partition panel wall and can not be seen from below the ceiling plane.

Figure 2:
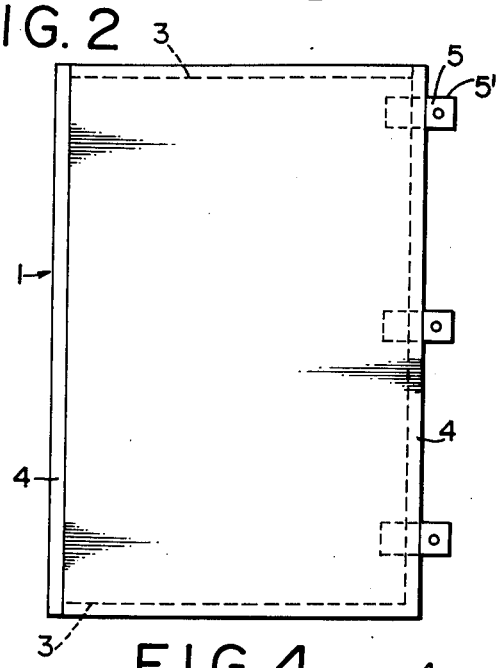
FIG. 2 is a surface side view of a ceiling panel according to this invention.
Figure 3:
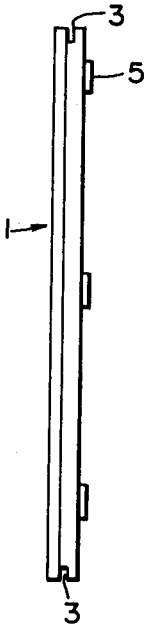
FIG. 3 is a right side view of the ceiling panel of FIG. 2.
Figure 4:
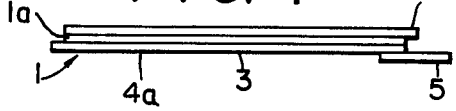
FIG. 4 is a bottom view of the ceiling panel of FIG. 2.
Figure 10:
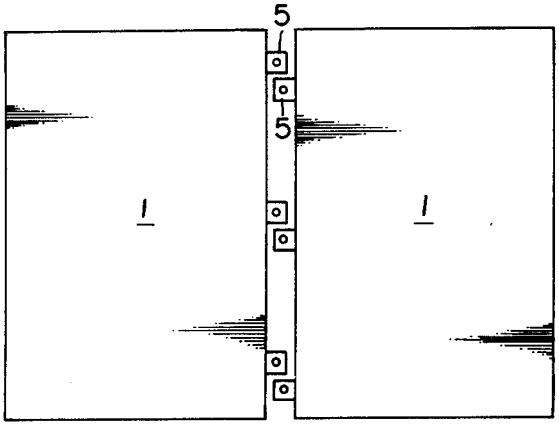
FIG. 10 is a view showing a mode for connecting two ceiling panels by means of joint annexes.

FIGS. 2, 3 and 4 show the detailed construction of a reference ceiling panel 1. Reference panel 1 may comprise a wooden frame or core 1*a* having a surface material glued on one or two side surfaces thereof. The opposed lateral side edges of panel 1 are provided with a groove 3, whereas the opposed longitudinal side edges of the two surfaces 4 and 4*a* overhang as shown best in FIG. 4. One overhang extends from the upper half 4 at one side of the panel and the other overhang extends from the lower half 4*a* at the opposite side of the panel. It will be understood that either or both of the surfaces 4 and 4*a* may be formed integrally with the frame or core. A plurality of joint annexes or brackets 5, made from iron, steel or other sheet metal, are nailed or otherwise affixed to the lower half surface material 4*a* so as to extend outwardly from one longitudinal side edge as shown in FIG. 4. Brackets 5 are spaced with a certain regularity as exemplified in FIG. 10 wherein two panels 1 which are to be connected in alignment by their adjacent side edge having brackets 5 positioned in such a manner that the adjacent brackets 5 can be interengaged with each other without contacting or overlapping. It should be noted that in FIG. 10 the panels 1 are identical, but one panel is rotated 180° relative to the other. Brackets 5 may be flat as shown in FIG. 4 or they be angled or double bent as shown in FIG. 6.

Figures 5, 6:
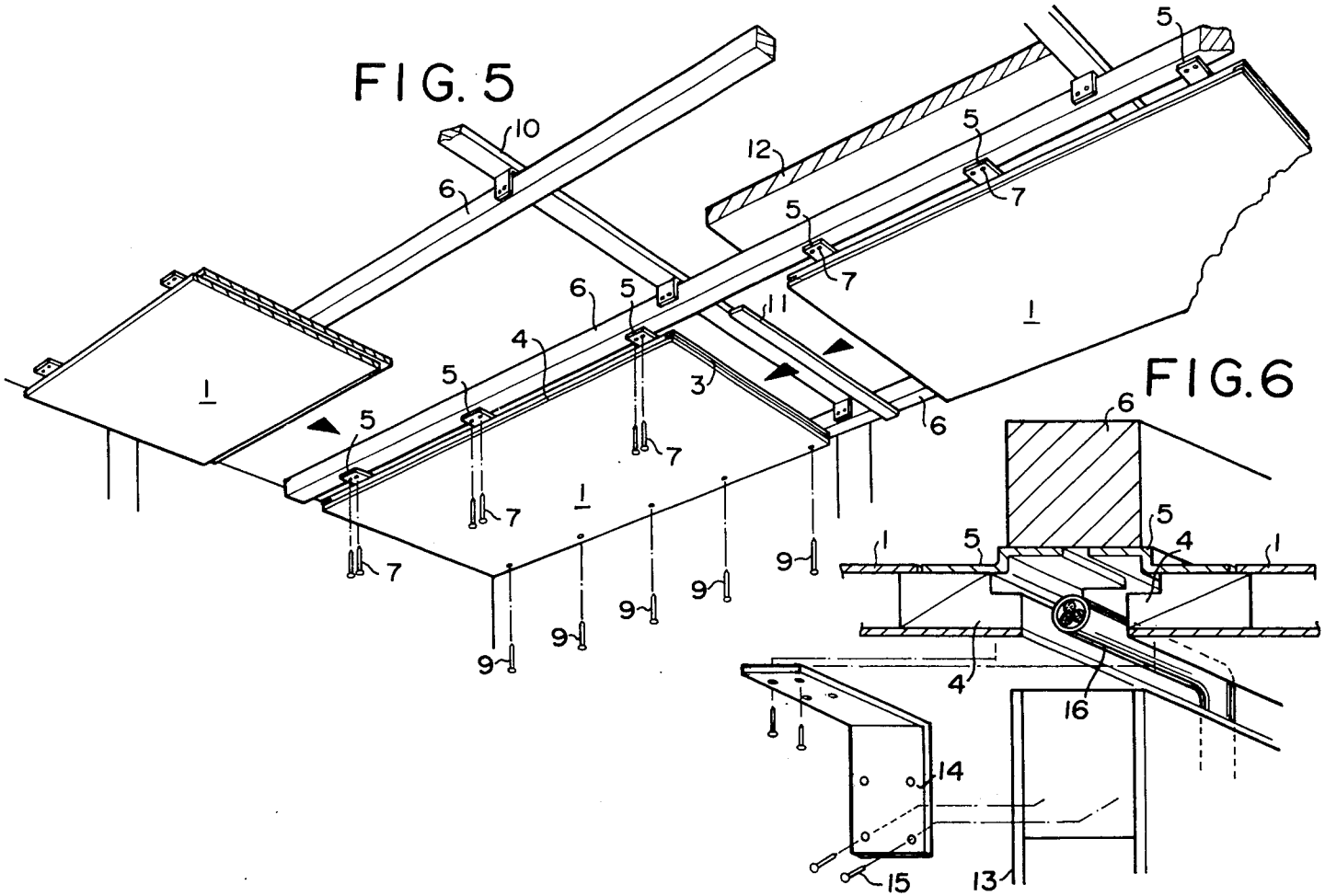
FIG. 5 is a view showing a mode for assembling the ceiling panels.
FIG. 6 is a view showing a mode for accommodating wiring in the resulting gap.

As shown in FIG. 5, panels 1 are connected to the lower surface of ceiling joists 6 by their adjacent side edges having brackets 5 attached thereto.

Figure 7:
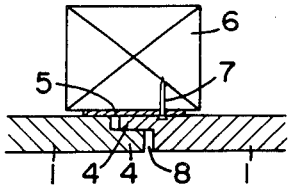
FIG. 7 is a view showing a mode for connecting longitudinal adjacent side edges of the ceiling panels.

As shown in FIG. 7, a panel of the type wherein the core and cover surface are integrally formed of one piece is positioned so that the brackets 5 are first brought against the lower surface of ceiling joist 6 where they are nailed to the joist 6 by a nail or nails 7. Secondly, the side edge of another panel 1, not having any brackets 5 on that side edge is inserted between the nailed brackets 5 and the half surface 4 of the first positioned panel 1. Thus, the half surface 4 and bracket 5 of the panel first installed forms a groove arrangement for receiving a tongue which comprises the half surface 4 of the second panel installed. A slit may be left between adjacent panels to form a stripe design, or the adjacent side edges of the panels may be abutted with each other. In either event, nails 7 are concealed to provide a good appearance.

As shown in FIG. 5 the outermost end portion of the panel 1 is nailed to a ceiling joist 6 by nails 9. Referring to FIG. 1, the nails 9 would be required only on the upper edges of the first three panels erected for rooms 1R and 3R, and at the lower edges of the first three panels erected for rooms 2R and 4R.

Figure 8:
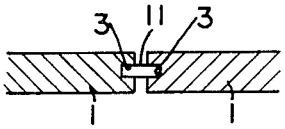
FIG. 8 is a view similar to FIG. 7 wherein lateral adjacent side edges are connected.

As shown in FIG. 5, the adjacent side edges having a groove 3 are connected to each other below a truss 10 by means of a slip feather 11 fitted in the opposed grooves 3. This detail is best shown in FIG. 8. Even in this case, the adjacent side edges of the panels may be abutted with each other if the width of slip feather 11 is small enough. Member 12 in FIG. 5 is an insulating material such glass wool or the like provided above the backs of panels 1.

Figure 9:
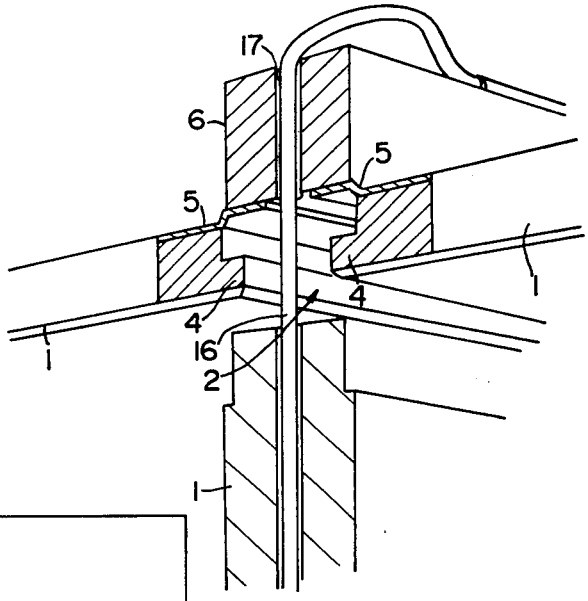
FIG. 9 illustrates another mode view for accommodating wiring.

FIG. 6 shows a method of assembling a partition panel wall 13 immediately below a gap 2 (See FIG. 1) resulting from the longitudinal and lateral connections of panels 1 as described above. The panel 13 is positioned immediately below gap 2, the top surface of the panel 13 overlapping the bottom surfaces of two adjacent panels 1. A joint bracket 14 is nailed to the top of the end surface of panel 13 and the bottom surfaces of the panels 1 by nails 15. At this time, gap 2 can be used as a space for laying electrical wiring and the like. A wiring cable 16 passing through partition panel wall 13 can be easily accommodated in gap 2. As shown in FIG. 9, wiring cable 16 may be extended to pass through a hole 17 of ceiling joist 6 and into the space above the ceiling.

Figure 11:
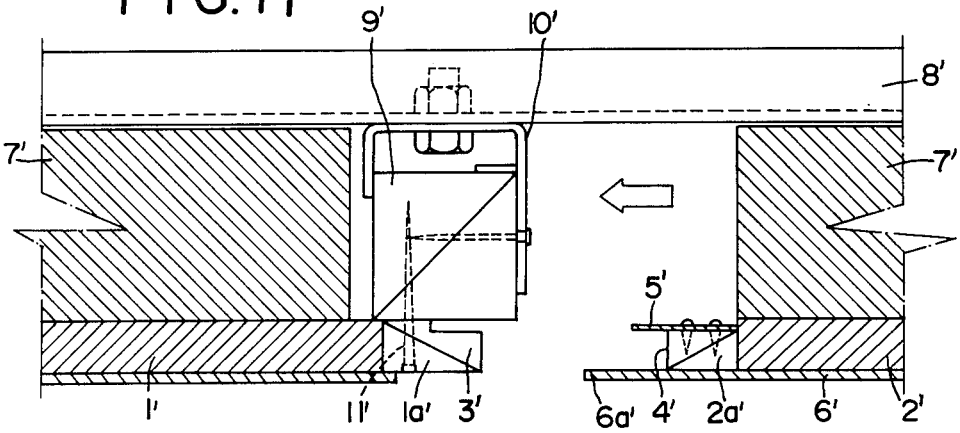
FIG. 11 is a sectional view showing another mode of assembling ceiling panels.
Figure 12:
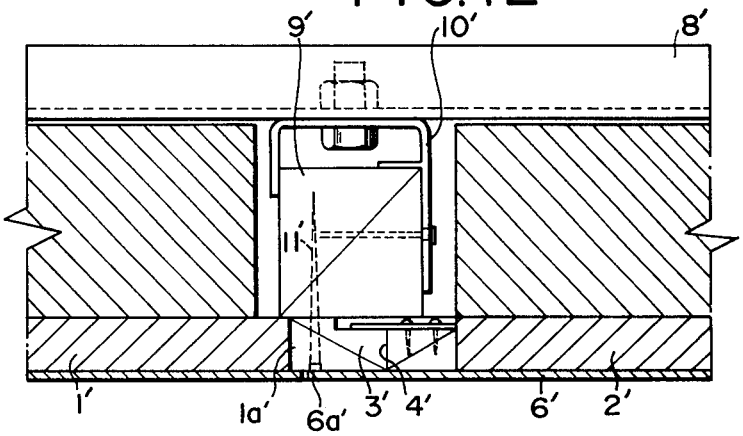
FIG. 12 is a view similar to FIG. 11 but showing the panels in assembled condition.

FIGS. 11 and 12 show another method of connecting two ceiling panels 1′ and 2′ having respective opposed joint constructions. A joint tongue 3′ extends from the frame 1*a*′ of panel 1′. A groove 4′ is provided on the edge of panel 2 to receive tongue 3′. A joint plate 5′ is secured by nails or the like to the frame 2*a*′ of panel 2′. A decorative plywood 6′ is glued or otherwise affixed to the outer surface of panel 2′ to have its one extremity 6*a*′ extending beyond 2′. An insulating material 7′ of, for example, foamed styrene resin is positioned above panels 1′ and 2′. A bottom chord 8′ of a gable truss is attached to a ceiling joist 9′ by a fixture or bracket 10′.

Immediately below ceiling joist 9′ two adjacent panels 1′, 2′ are disposed with their joint ends one to the other. Prior to this disposition, joint tongue 3′ of side panel 1′ is nailed to ceiling joist 9′ by a nail 11′. Then, joint groove 4′ of the another side panel 2′ is abutted with joint tongue 3′, whereby the head of nail 11′ is covered by extended extremity 6*a*′ of decorative plywood 6′.

Figure 17:
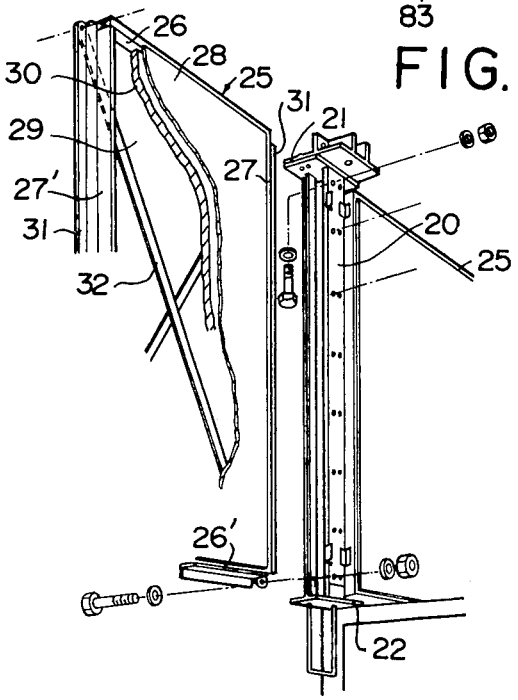
FIGS. 16 and 17 show a mode for assembly of outer wall panels.
Figure 16:
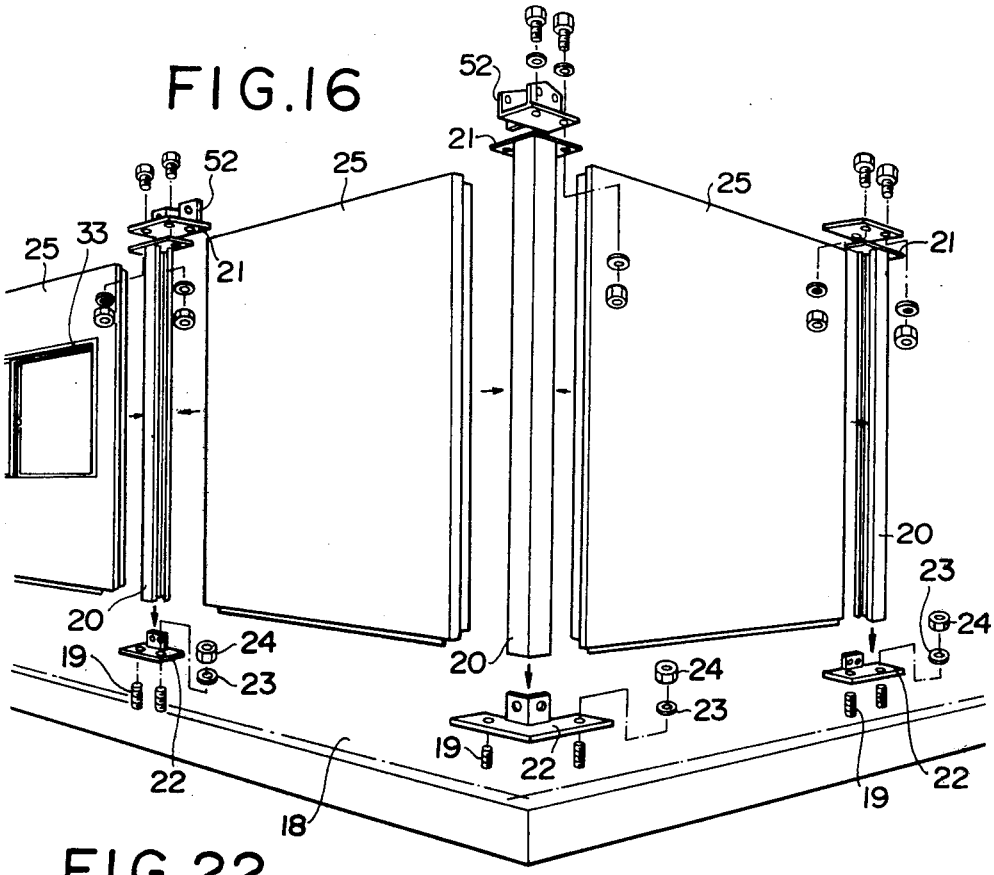
Figure 18:
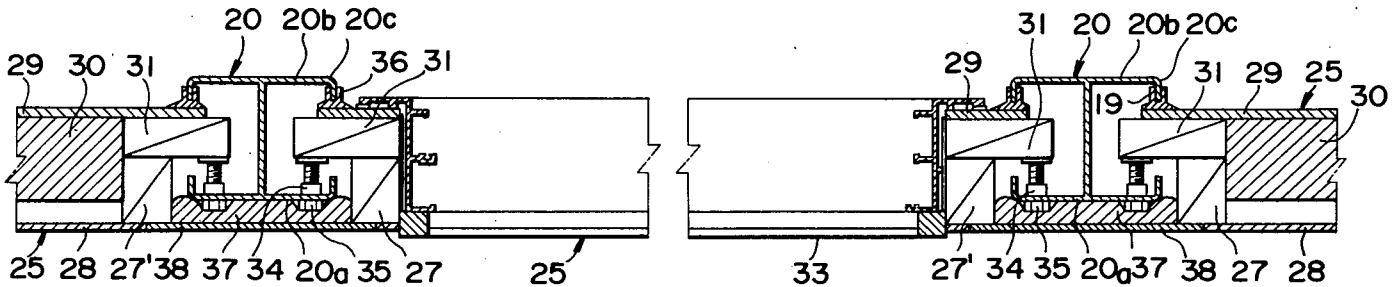
FIG. 18 is a sectional view showing the connection of posts with outer panel walls.

FIGS. 16 and 17 show a method of assembling outer wall panels and FIG. 18 shows a portion of an assembled outer wall. I-section metal posts 20 are attached to a slab or mat foundation 18 by angle member 22 and anchor bolts 19, the bolts 19 being buried in position in foundation 18. The top end of each post 20 has an upper angle member 21 secured thereto.

Outer wall panels 25 each have an upper frame member 26 and a lower frame member 26′ as well as two side frame members 27 and 27′. The four frame members are arranged in a rectangular form. A decorative plywood 28 is glued to the indoor side of the frame members, and an insulating material 30 is provided in the interior of the rectangular frame. The longitudinal side frames 27 and 27′ are provided with a rail 31. Cross braces 32 may be built into the outer wall panel 25 to afford greater strength. An outer wall panel 25 may be provided with an opening for a window sash 33 or the like.

Outer wall panels 25 are set up between adjacent posts 20 in closed relation as shown in FIG. 18. An outer wall panel 25 is positioned so that its rail 31 extends into the grooved opening of post 20. A nut 34 is welded to the indoor flange 20*a* of post 20. A bolt 35 is screwed through nut 34 and tightened so that its end exerts a thrust against one side face of rail 31. By means of this thrust, the opposed side face of rail 31 is watertightly secured against the edge 20*c* of the outdoor flange 20*b*. A seal means 36 is provided which extends along the length of the edge 20*c*. The head of bolt 35 is coated with a waterproof material 37 once the bolt is screwed into position. A finish plywood 38 is then glued to material 37 in alignment with the finish plywood layer 28 of outer wall panel 25.

Figure 19:
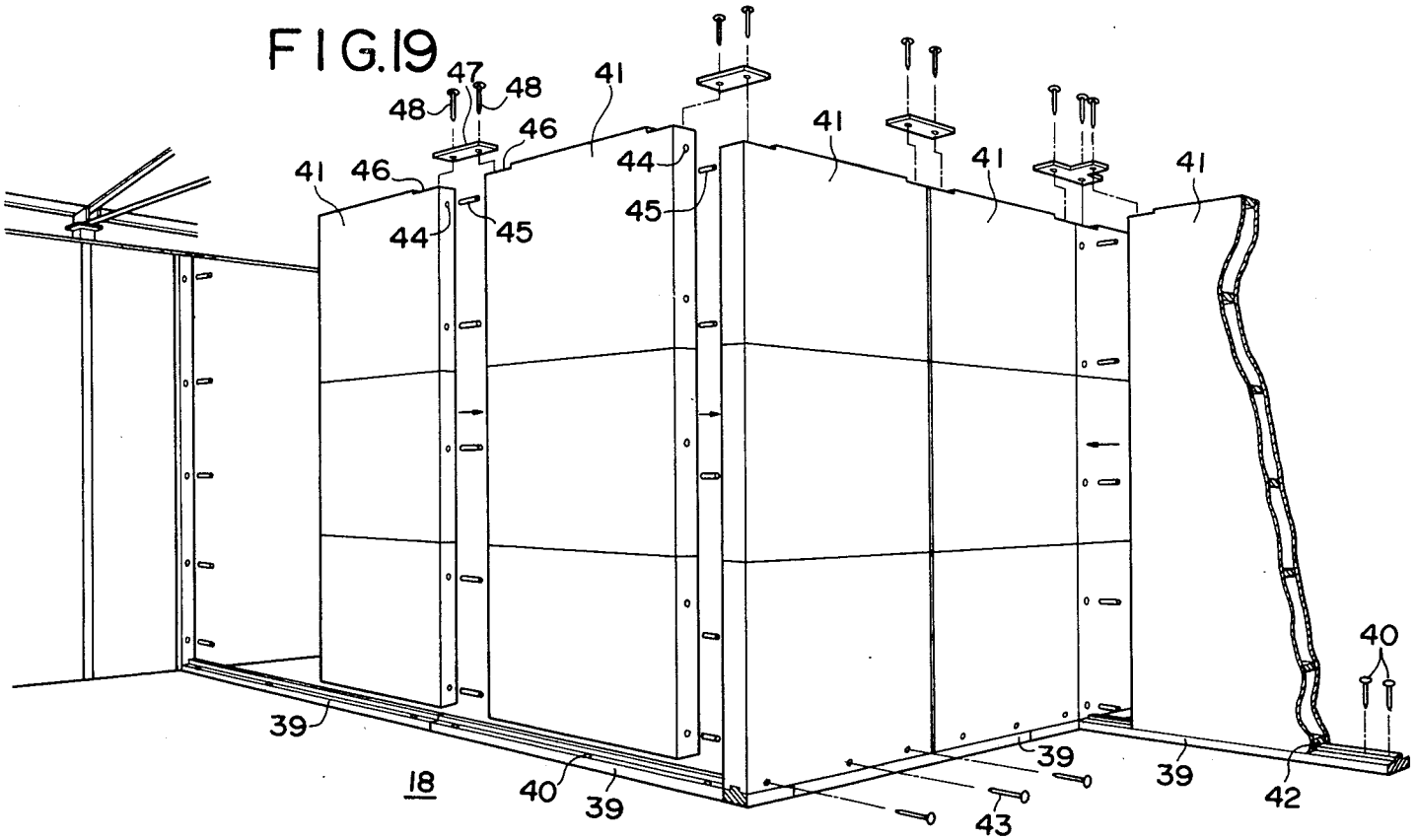
FIG. 19 shows a mode for assembly of partition panel walls.

FIG. 19 shows the assembly of a plurality of partition wall panels 41. A wall rail 39 is secured by nails or other fasteners 40 to foundation 18 in accordance with a room plan such as that shown in FIG. 19. Each partition wall panel 41 has its lower end face grooved to fit over and match a tongue on the top of rail 39. Nails 43 are driven at an oblique angle to tie the panels to the rail 39. The longitudinal adjacent side faces of panels 41 are provided with mortises 44. Two partition panel walls 41 are connected in abutment with each other by means of mortises 44 and dowels 45 or the like. If necessary, a joint bar or fastening plate 47 may be placed on two recessed top portions 46 of adjacent panels 41 and nailed thereto by nails 48.

Figure 25:
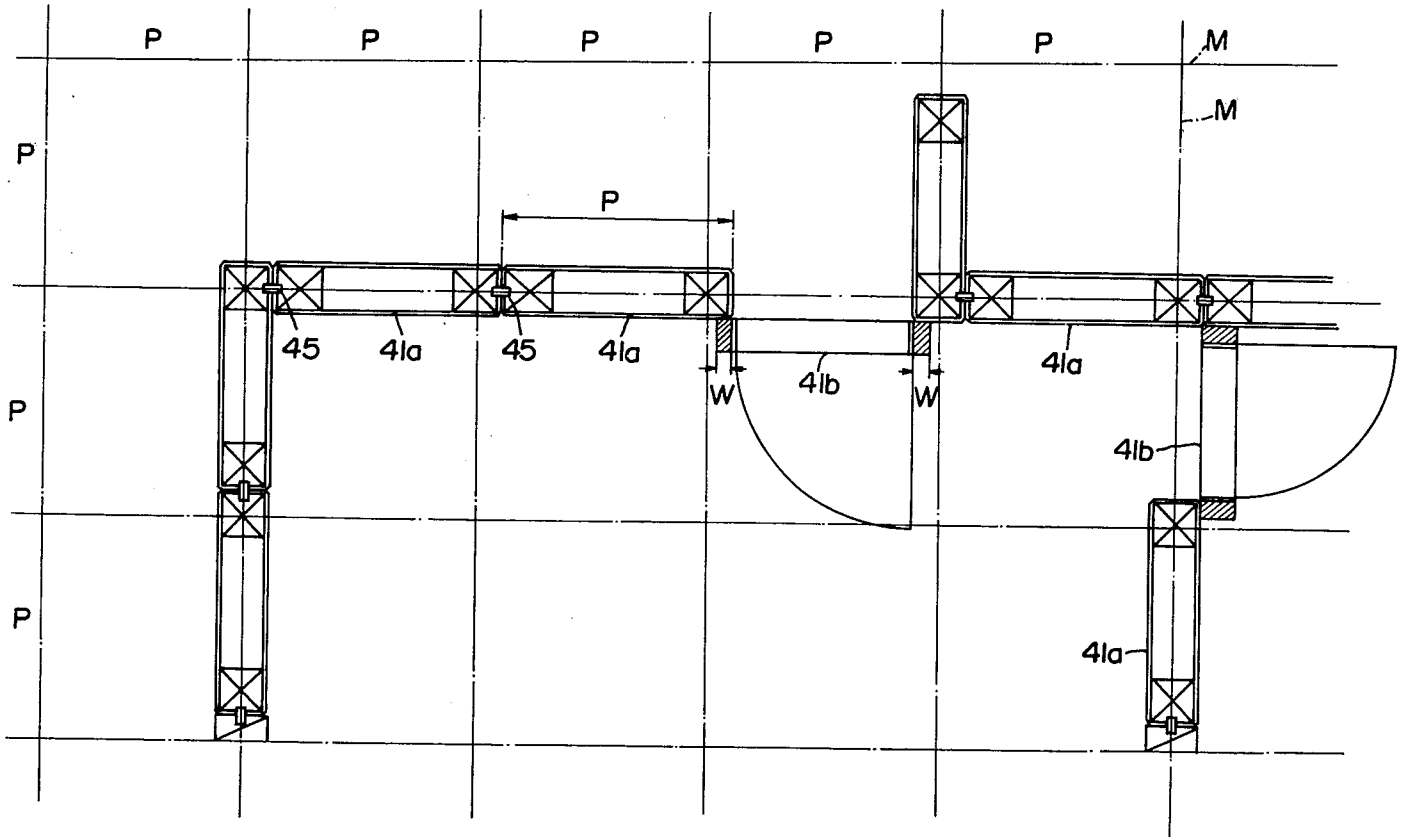
FIG. 25 is a view of a partition panel wall arrangement.

A typical arrangement of partition wall panels 41 is shown in FIG. 25, where both blind wall panels 41*a* and open wall panels 41*b* are used. Blind wall panels 41*a* alone are disposed in accordance with a modular dimension P and aligned in abutment with each other along a modular line M. As a result, blind walls 41*a* leave an opening which is one wall thickness less than a module width P. To compensate for this modular deviation, open wall panels 41*b* which provide for a door or the like, are offset from the modular line M and are made to overlap two blind wall panels 41*a* by a distance *w*.

Figure 20:
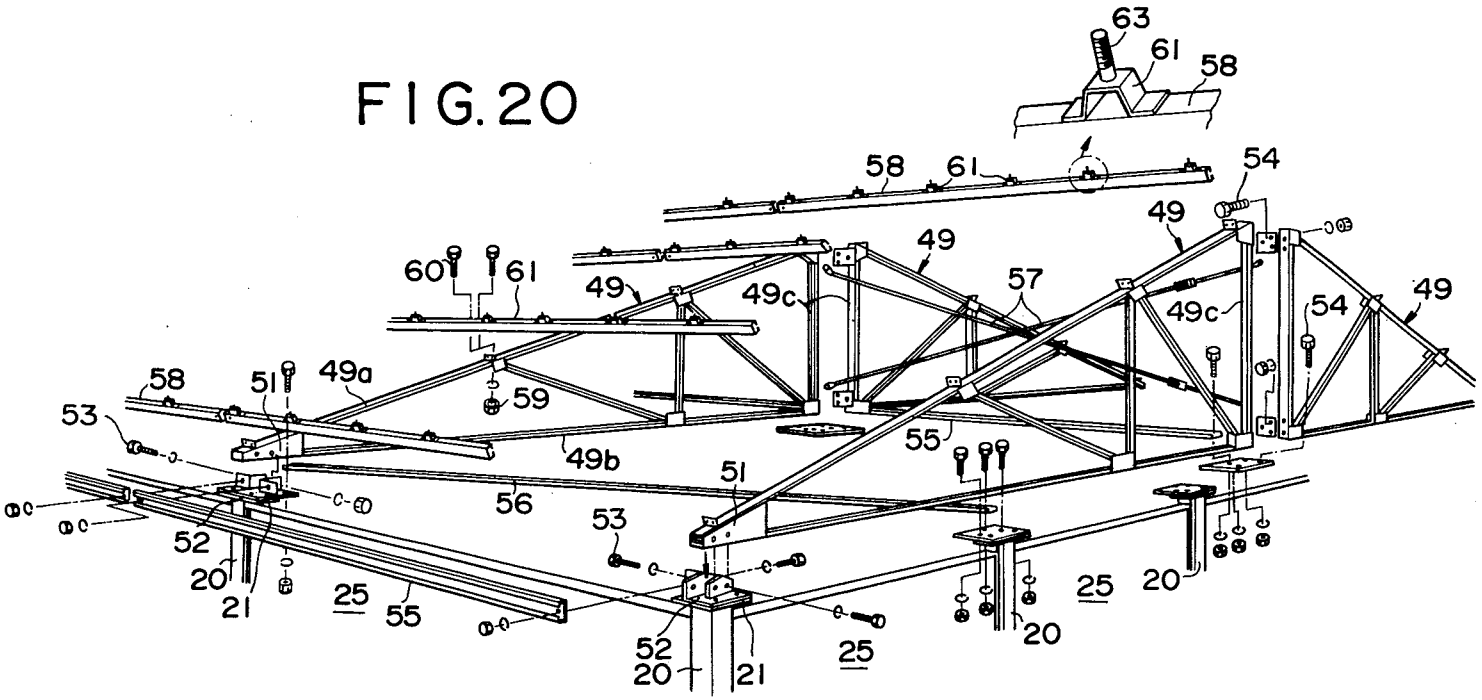
FIG. 20 illustrates a gable roof assembly.
Figure 21:
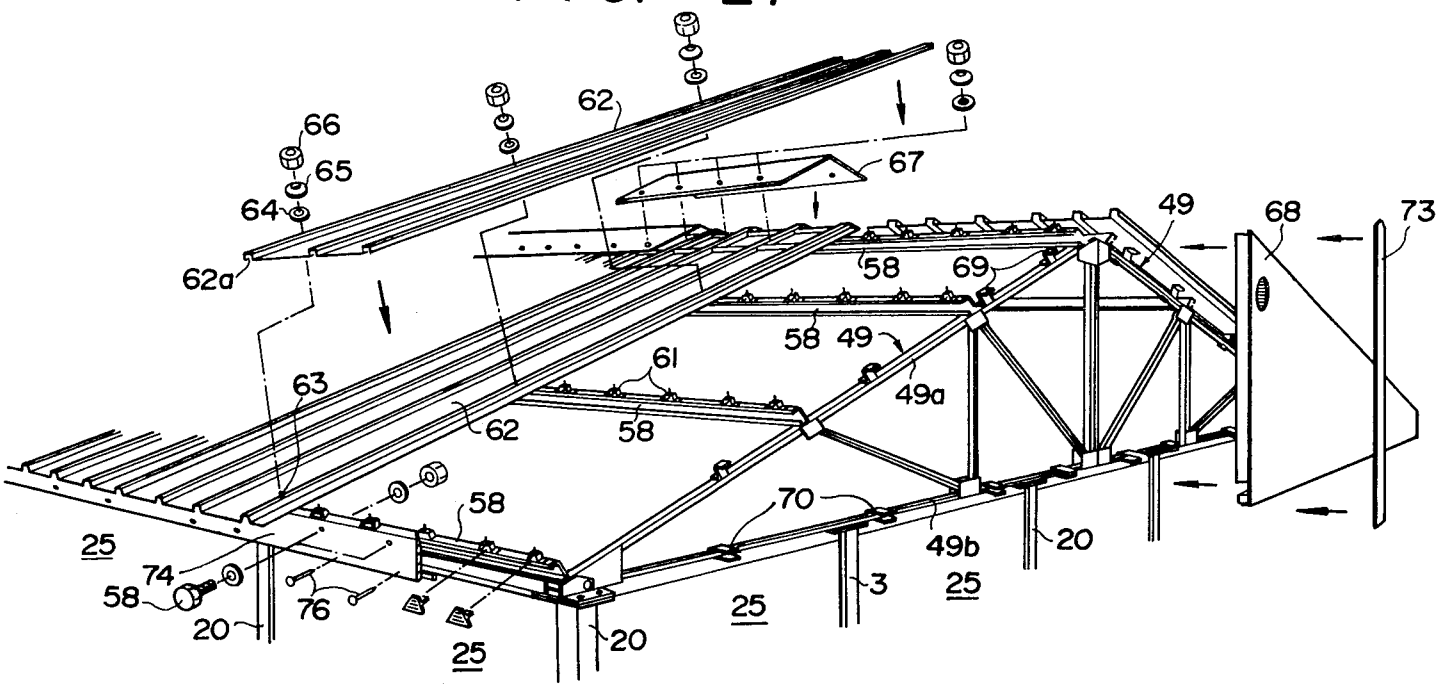
FIG. 21 illustrates the mounting of roof decks.

FIG. 20 shows a method of building up a gable roof. A truss 49 includes complementary left and right divisional parts as well as joint portions for the king post portion in the middle. Trusses 49 in divisional condition are mounted on posts 20. A tie corner 51 with a top chord 49*a* and a bottom chord 49*b* is secured to a fixture 52 annexed to the upper plate 21 of post 20 by bolts 53. Adjacent king posts 49*c* are connected together by bolts 54. Longitudinally spaced trusses 49 are tied together by tie beams 55, corner angle beams 56 and braces 57. Longitudinally spaced top chords 49*a* are crossed with upper purlins 58 and attached thereto by means of fixtures 59 and bolts 60. Upper purlins 58 are provided with hut-shaped fixtures 61 at spaced intervals for mounting roof decks 62 as shown in FIG. 21. The hut-shaped fixtures are provided with an upwardly projecting bolt 63 and are adapted to be snugly accommodated in groove portions 62*a* of roof decks 62 with the bolt extending through the roof deck.

FIG. 21 shows a method of mounting roof decks and gable panels. Roof decks 62 are mounted on purlins 58 sequentially in the longitudinal direction, with fixtures 61 being fitted in groove portions 62*a* and bolts 63 projecting through roof decks 62. Nuts 66, washers 64 and gum packing 65 hold the decks in place and provide a weather-tight seal where bolts 63 extend through the roof decks. The roof decks 62 are bolted as explained to prevent a strong wind from blowing the roof off. Thus, a number of bolts 63 may be used to prevent the roof decks from being blown away by an extremely strong wind.

Figure 22:
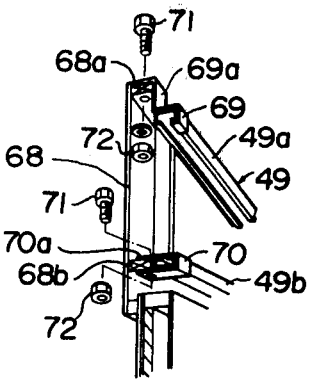
FIG. 22 illustrates the mounting of gable panels.
Figure 24:
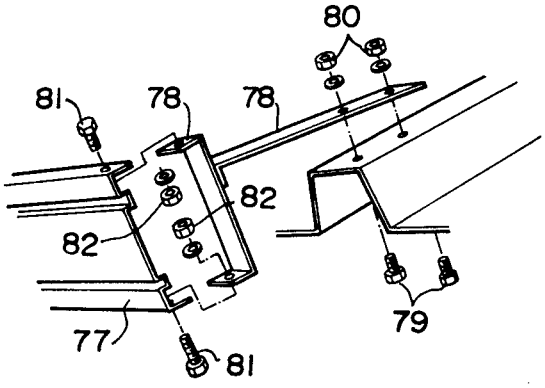
FIG. 24 is a partially detailed view of FIG. 23.

The roof ridge is covered by a ridge cover 67, which is fastened by bolts 63 of the fixtures 61 which are attached to the ridge purlin. The attachment of gable panels 68 with the outermost truss 49 is shown in FIG. 22, where two different brackets 69 and 70 having respective L-shaped and U-shaped portions 69*a* and 70*a* are secured to a truss top chord 49*a* and a truss bottom chord 49*b*, respectively. The top chord 68*a* of gable panel 68 is grasped in L-shaped portion 69*a* and the bottom chord 68*b* is grasped in U-shaped portion 70*a*. The respective couples are fastened by bolts 71 and nuts 72. Left and right gable panels 68 are connected at their vertical side edge by means of a separate gable joint 73. A wall plate 74 is fastened to the lowest purlin 68 by bolts 75 and fastened to the upper portion of the outer wall panels 25 by bolts 76.

Figure 23:
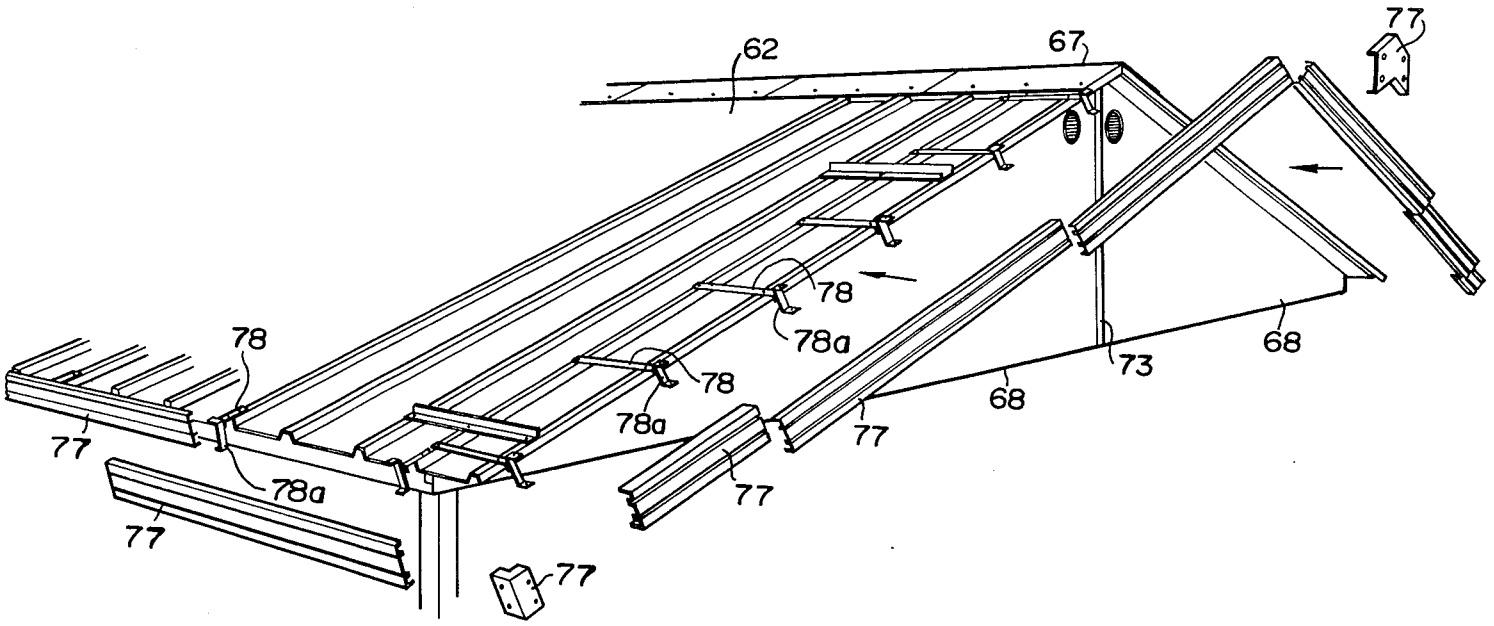
FIG. 23 illustrates the annexing of parapets.

FIG. 23 shows a method of attaching parapets with the ends of roof decks 62. The parapets 77 can be divided in several kinds, i.e., longitudinally fixed side ones, corner angle ones and inverted v-shaped ones for front ridges. A number of parapet receivers or arm brakcets 78 having a U-shaped portion 78*a* are fastened to the outer edges of a roof deck arrangement by bolts 79 and nuts 80.

Figure 13:
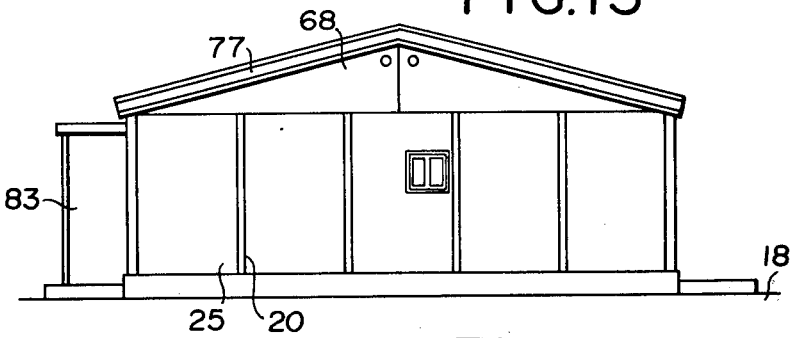
FIG. 13 is a side view of a prefabricated house according to this invention.
Figure 14:
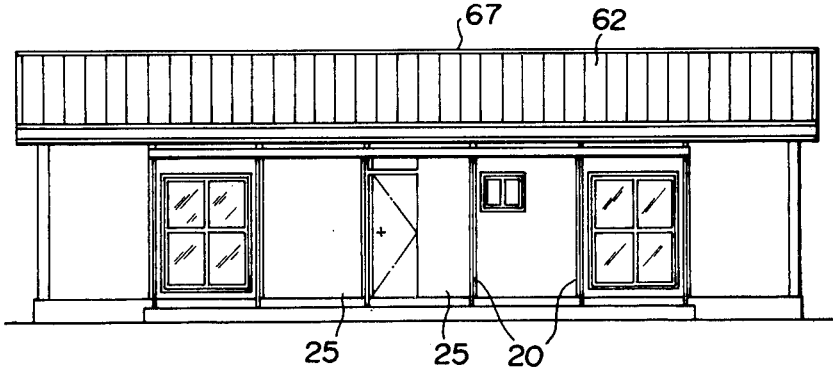
FIG. 14 is a front view of the house.
Figure 15:
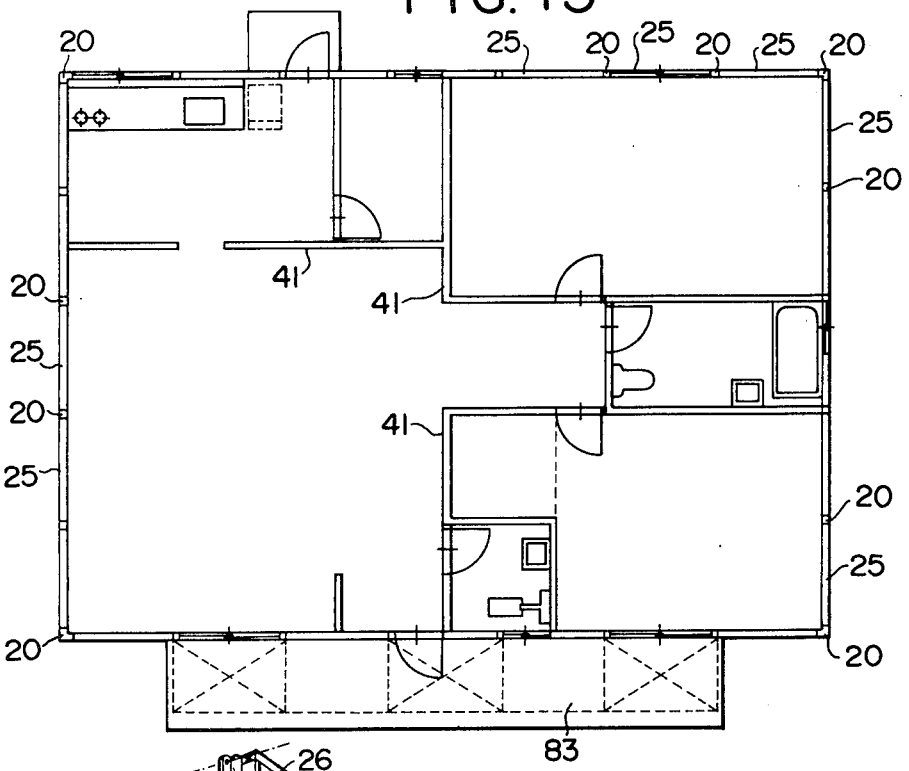
FIG. 15 shows an example of room planning.

Longitudinally fixed side parapets 77 are mated with U-shaped portions 78*a* to conceal the outer edge of roof decks 62. Bolts 81 and nuts 82 secure the parapets to the U-shaped portions. The adjacent parapets 77 are partly overlapped. By completion of all the assemblies of various building parts as aforesaid, a prefabricated house is obtained as shown in FIGS. 13–15. A terrace 83 may be added to the house if desired:

I claim:

1. A prefabricated house having a ceiling plane defining inside dimensions extending between inside surfaces of house outer walls, said house further including a plurality of partition wall panels disposed vertically to said ceiling plane inside said outer walls to form a partition wall, some of said partition wall panels being blind ones and at least one of them being open, said ceiling plane comprising reference ceiling panels with their longitudinal dimension equal to or greater than $MP/m - D/m$ and with their lateral dimension equal to or greater than $NP/n - D/n$, wherein MP is the longitudinal inside dimension of the ceiling plane, NP is the lateral inside dimension of the ceiling plane, $m$ is the number of ceiling panels to be longitudinally disposed, $n$ is the number of ceiling panels to be laterally disposed, and D is the thickness of a partition panel wall, said ceiling panels normally abutting adjacent ceiling panels, but being positioned to leave gaps with a dimension less than D upon disposition thereof, whereby blind ones of said partition wall panels are disposed immediately below said gaps along a modular line and open ones are offset from said modular line to have their one or two end portions lapped in parallel with their adjacent blind one, thereby compensating for modular deviations with the resulting lapped portions.

2. A prefabricated house as claimed in claim 1, wherein said partition wall panels form more than two partition walls in the longitudinal and lateral directions, said reference panels having their longitudinal dimension equal to or greater than $MP/m - \mu D/m$ and their lateral dimension equal to or greater than $NP/m - \gamma D/n$, wherein $\mu$ is the number of the partition walls longitudinally disposed and $\gamma$ is a number of partition walls laterally disposed.

3. A prefabricated house as claimed in claim 1, wherein the partition wall panels each have a lower end face which is grooved, and wherein said house further includes a mat foundation having a rail mounted thereon, said rail having an upwardly extending tongue adapted to be received into said grooved faces as said partition wall panels are moved into place.

4. A prefabricated house as claimed in claim 1, wherein said partition wall panels have longitudinal adjacent side faces provided with mortises; and wherein are further included a plurality of dowels fitting said mortises to hold said wall panels in abutting positions.

5. A prefabricated house as claimed in claim 1, and including a wiring construction disposed in said gaps formed immediately above the partition wall panels.

6. A prefabricated house as claimed in claim 5, and further comprising a ceiling joist disposed above said gaps, said wiring construction extending through a hole in said ceiling joist into a region above a ceiling plane.

7. A prefabricated house as claimed in claim 1, wherein the longitudinal adjacent edges of the reference ceiling panels have mating recessed configurations; and wherein is further included separate bracket means attached to one surface of each reference ceiling panel to extend over one longitudinal edge thereof to, in conjunction with said recess, form a tongue and groove arrangement for interfitting with a mating configuration of said adjacent edge.

8. A prefabricated house as claimed in claim 7, wherein the laterally adjacent edges of the reference ceiling panels have a groove formed therein; and wherein is further included slip feather means inserted in the grooves of adjacent end edges to connect adjacent reference ceiling panels.

* * * * *